United States Patent [19]

Nystrand

[11] 4,163,548

[45] Aug. 7, 1979

[54] METHOD OF LAPPING WEBS AND PRODUCT

[75] Inventor: Ernst D. Nystrand, Scottsdale, Ariz.

[73] Assignee: Paper Converting Machine Company, Green Bay, Wis.

[21] Appl. No.: 871,236

[22] Filed: Jan. 23, 1978

[51] Int. Cl.[2] ..... B41L 1/32

[52] U.S. Cl. ..... 270/39

[58] Field of Search ..... 270/39–40; 271/182, 202

[56] References Cited

U.S. PATENT DOCUMENTS

| | | | |
|---|---|---|---|
| 3,034,780 | 5/1962 | Stelling | 270/39 |
| 3,489,406 | 1/1970 | Nystrand | 270/39 |
| 3,701,522 | 10/1972 | Chi | 270/39 |

*Primary Examiner*—Paul T. Sewell
*Assistant Examiner*—A. Heinz
*Attorney, Agent, or Firm*—Tilton, Fallon, Lungmus & Chestnut

[57] ABSTRACT

A method of lapping webs to provide a product suitable for zig-zag folding or rewinding wherein a web is advanced from each of a pair of parent rolls, the web transversely severed into discrete identical sheets which are then lapped no more than one-third the length of each sheet, and thereafter the lapped sheets from each parent roll are combined in staggered reverse relationship whereby all exposed edges face one direction.

3 Claims, 5 Drawing Figures

METHOD OF LAPPING WEBS AND PRODUCT

BACKGROUND AND SUMMARY OF INVENTION

This invention relates to a method of lapping webs and the product resulting therefrom and, more particularly, to webs which thereafter can be further processed as by zig-zag folding or rewinding.

In the aspect of the invention where the webs are zig-zag folded, such webs may be used for interfolded tissue and towel products having a pop-up feature. In the past, the ways of producing such interfolded products fell into two categories. One category involved the so-called continuous method where there were as many parent rolls as the count required in the retail package, i.e., for a 200 count package of tissues or towelling, more than 200 parent rolls were required. The extra parent rolls were required to compensate for the webs which may break during processing or when a given parent roll was exhausted and time required to replace it. Thus, producers face the prospect of over-compensating and very often a nominal 200 count package had 202, 203, etc. sheets therein. Where the number of parent rolls has been reduced as by deriving, for example, 10 webs from a single parent roll by slitting the wide roll, and thereby reducing the number of parent rolls to 20, the continuous feature is lost because parent rolls cannot be replaced on the fly under such circumstances. Additionally, the folds were produced longitudinally of the sheet length and the sheet was therefore dispensed in the cross machine direction of the paper machine which is usually considerably weaker than the strength of the web in the machine direction.

The other method of producing interfolded products used one or two parent rolls (or possibly twice as many parent rolls for two-ply products). Here the folds were produced transversely and the sheet dispensed in the stronger machine direction of the paper machine.

The instant invention falls in the second category where there have been historically two major types of folds and machines to produce them: (1) single fold, and (2) multi-fold. The single fold has the webs lapped one-half their length or alternatively can be considered a V-fold. The multi-fold, on the other hand, embodies three leaves of panels lapped one-third the length of the sheet and zig-zag folded so as to approximate a Z-fold.

Since the single fold machines made use of two parent rolls and the multi-fold only one parent roll, the productive capacity of the single fold machines have made these very attractive. In spite of this, the multi-fold product has enjoyed popularity, mainly because of the slim profile of its dispenser in public washrooms—the width being determined by the distance between folds, i.e., one-third versus one-half the sheet size.

The inventor hereof has tried for some 30 years to increase the output of the multi-fold machines by doubling the number of parent rolls to equal the single fold machines in production. The answer turned out to be in what the applicant chooses to call, in the preferred aspect, double three-leaf multi-fold. In explanation of this, it should be noted that the conventional three-leaf multi-fold is produced as shown by the inventor's prior U.S. Pat. No. 3,490,762 where one web, fed from a parent roll, is cut to desired sheet lengths, these sheets are then brought into an overlapping relationship and fed to zig-zag folding rolls. Although the U.S. Pat. No. 3,490,762 is of fairly recent vintage—being directed to a novel lapping means with accommodation for the slack produced the basic idea of three-leaf multi-folding is quite old, the first machine for this purpose on which the inventor hereof worked was built over 40 years ago.

The invention here concerns two parent rolls, each web being separately cut to discrete sheets, each web having its own lapping system and thereafter the lapped sheets from the two individual parent rolls are brought together in a staggered reverse relationship whereby all of the exposed edges face one direction. The combined webs can then be zig-zag folded as in the conventional system or, alternatively, rewound for sequential dispensing.

DETAILED DESCRIPTION

The invention is described in conjunction with an illustrative embodiment in the accompanying drawing, in which.

Figure 1:
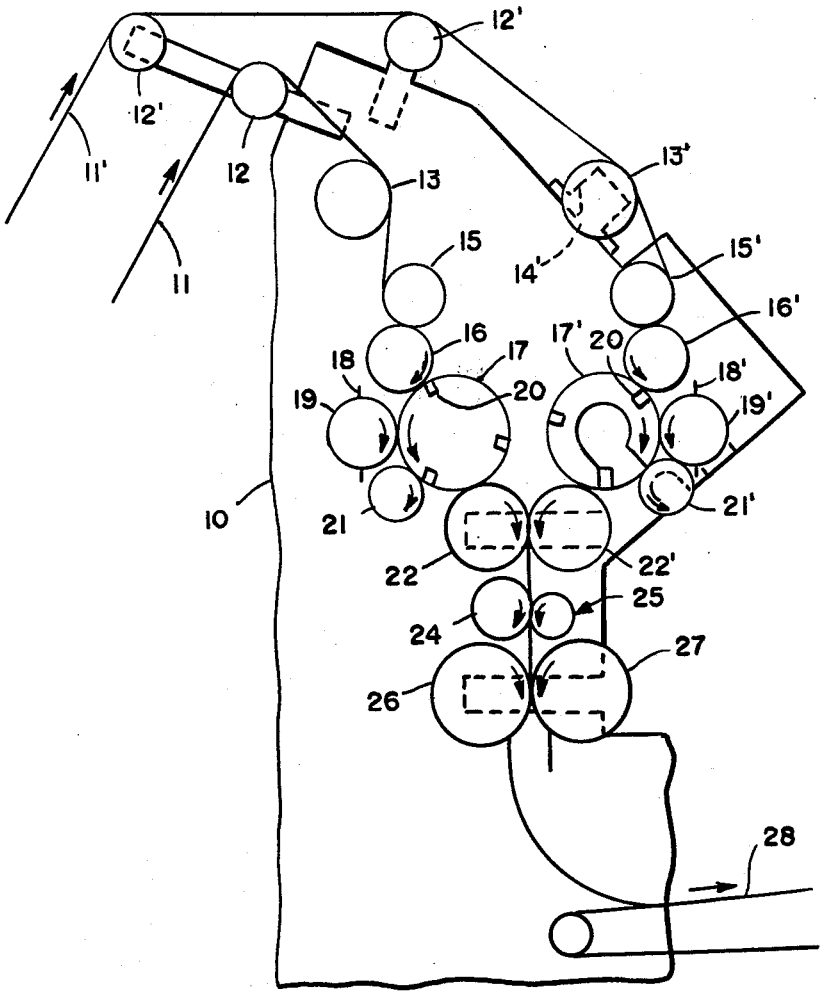
FIG. 1 is a schematic elevational view of apparatus which can be used advantageously in the practice of the invention.

In the illustration given and with reference first to FIG. 1, the numeral 10 designates generally a frame of a machine for lapping and zig-zag folding. The elements to be described hereinafter can be seen and described in greater detail in the previously mentioned U.S. Pat. No. 3,490,762. Even further, in a sense, the machine carried by the frame 10 makes use of two sets of certain of the elements of the machine shown in the U.S. Pat. No. 3,490,762 patent. To the extent that elements are duplicated, they will be referred to by the same reference number but with the addition of a prime (').

Still referring to FIG. 1, the numeral 11 refers to a first web which is derived from a parent roll (not shown). As indicated just previously, a second web 11' is derived from a second parent roll (also not shown). The web 11 passes over an idler roll 12 and then over a spreading roll 13 which is generally known to the trade as a "Mount Hope" roll, having a curved surface for eliminating wrinkles. In like fashion, the web 11' passes over a pair of idler rolls 12' and then over a Mount Hope roll 13'. The Mount Hope roll 13', for example, is supported on the frame 10 by means of a pedestal and bearing generally designated 14'.

Returning to the web 11, after the same has passed over the Mount Hope roll 13, it is seen to engage draw rolls 15 and 16 and thereafter is in partial wrapping engagement with a bed roll designated 17. Here it may be noted that the element designation parallels as much as possible the designation of the same elements in the U.S. Pat. No. 3,490,762 patent.

The web 11' after passing over the Mount Hope 13' engages draw rolls 15' and 16' and thereafter is directed into partial wrapping engagement with a bed roll 17'. Here the web is caused to adhere to the bedroll by vacuum and is cut by serrated blades, one of which is shown at 18 and 18', respectively, mounted on cutoff rolls 19 and 19'. Each blade 18 or 18' cuts the web 11 or 11', respectively, as it enters a mating groove as at 20 or 20' in the respective bedroll, 17 or 17'.

A pinch roll 21 or 21' is associated with the cutoff roll 17 or 17' and prevents the web (now a segment) from backing up at cutoff and ensures cleaner and better cutoff. The elements 18–21 (alternatively 18'–21') may be modified somewhat depending upon the character of the cutoff. For example, if a shear type cutoff is employed as found in co-owned U.S. Pat. No. 2,870,840, the foregoing elements 18–21 may be modified somewhat.

The next roll in the path of the web 11 is the so-called "retard" roll and is designated 22. Lapping or shingling of webs has been carried out for years through the use of two basic rolls—the bedroll and the retard roll with the retard roll traveling at a slower surface speed than the bedroll. As the leading edge of the cut web comes close to the retard roll 22, the vacuum holding the leading edge of the web against the bedroll 17 is valved off and the corresponding vacuum in the bedroll 22 is valved on so as to transfer the leading edge of the severed web from the surface of the bedroll 17 to the surface of the retard roll 22. Once the leading edge of a cut web is transferred to the surface of the retard roll 22, the leading edge flows down while the trailing edge portion of a web is advancing at the same rate as the web 11. This creates a slack or loop in the trailing portion of the web which permits lapping by the leading portion of a succeeding web segment. Such lapping is illustrated at the left hand portion of FIG. 2 relative to the web segments cut from the web 11. Simultaneously, a second series of web segments (from the web 11') are lapped by the retard roll 22' to provide a series of lapped segments as illustrated in the right hand side of FIG. 2. The retard rolls 22 and 22' are essentially identical in makeup but are mounted so as to have their vacuum ports offset so as to achieve a "staggered" relationship of the webs in one set relative to the webs in the other set. Also, the retard rolls are mounted for rotation in opposite directions (as indicated by the arrows applied to FIG. 1) so that the web segments are laid down in a "reverse" relationship—also as can be appreciated from FIG. 2.

In the mechanism illustrated for the practice of the instant invention, there is no need for a cooperating roll such as that designated 23 in the earlier U.S. Pat. No. 3,490,762. The web segments from the webs 11 and 11' after they issue from the nip defined by the retard rolls 22 and 22' are in the configuration generally depicted in FIG. 2 and threafter pass between a slitter bedroll 24 and a multiple slitter 25. This separates the web segments into a plurality of narrower widths arranged side by side. Thereafter, the lapped web segments (still in the orientation depicted schematically in FIG. 2), pass between folding rolls 26 and 27 which may take the form of those illustrated in U.S. Pat. No. 3,489,406. The folding rolls 26 and 27 are equipped with cooperating tuckers and grippers and convert the web segments from the configuration depicted schematically in FIG. 2 to that depicted schematically in FIG. 3. This results in a stream of interfolded web segments which are guided away from the folding rolls 26 and 27 for removal by a conveyor as at 28.

Figure 2:
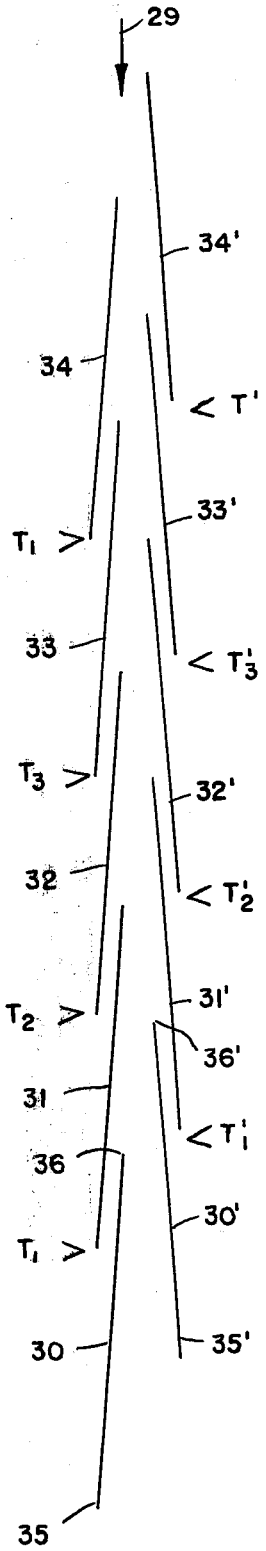
FIG. 2 is another schematic view showing the arrangement of sheets as the lapped sheets are combined prior to zig-zag folding.

Referring now to FIG. 2, the tuckers on the folding roll 26 have been designated $T_1$, $T_2$ and $T_3$. It will be noted that on the left hand side of FIG. 2 that the tuckers are indicated as being operative or engageable with the leading ends of the web segments, assuming the movement of web segments being in the direction of the arrow 29 applied to the upper portion of FIG. 2. The tuckers of the folding roll 27 are designated by the symbols $T_1'$, $T_2'$ and $T_3'$ and also operate against the leading edges of the web segments. These leading edges (as is the case with the trailing edges) are offset or staggered when considering those on the left hand side of FIG. 2 relative to the web segments on the right hand side of FIG. 2.

Also apparent from a consideration of FIG. 2 is the previously referred to "reverse" relationship of the web segments from the web 11 as compared to the web segments from the web 11'. For example, the leading edges of the web segments in both sets are exterior (as seen in FIG. 2) while the trailing edges are interior or internal of the segments.

The tuckers $T_1$, $T_1'$, $T_2$, etc. push the leading edge of a web segment from one web and the leading edge of a web segment from the other web into the grippers which subsequently close as the tuckers withdraw. The method of the instant invention has either all trailing edges or all leading edges exposed—as can be appreciated from a consideration of the showing in FIG. 2. The arrangement of sheets in FIG. 2 is that produced on the apparatus of FIG. 1 between the nip defined by the retard rolls 22 and 22' and the nip 19 between the folding rolls 26 and 27'. In FIG. 2, as illustrated, the sheets 30, 31, 32, 33 and 34 are derived from the web 11 while the sheets 30', 31', 32', 33', and 34' are derived from the web 11'. It will be noted that if the direction of movement of the sheets just described is in the direction of the arrow 29 applied to FIG. 2, the edges that are exposed are all leading edges as for example at 35 and 35'. It will be appreciated that if the flow of sheets is in the opposite direction, then the same exposed edges 35 and 35' will be "leading" edges. The remaining edges are trapped inside as at 36 and 36' where they cannot get away. Thus, the advantageous orientation of sheets has the sheets from each of the webs combined in a staggered, reverse relationship whereby all the exposed edges face one direction.

Exposed edges of the leading character have a slight advantage for zig-zag folding as they give the tuckers a chance to wipe these edges into the gripper. For rewinding, only the trailing edge variety is useful because the leading edge would frustrate the very act of rewinding. It will be seen from a consideration of FIG. 2 that the overlap is one-third the length of each sheet 20, 21, 22, etc. The lapped portion should be no more than one-third the length of each sheet but may be less.

Figure 3:
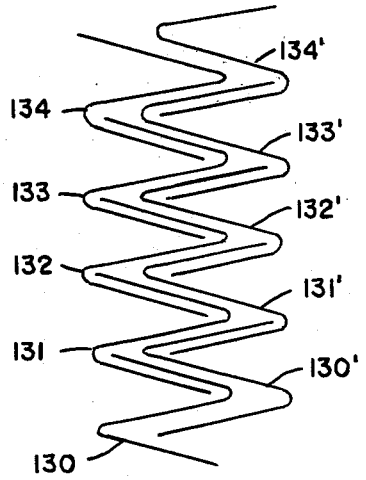
FIG. 3 is a schematic view of the combined sheets after zig-zag folding but with the sheets from the two webs spaced apart or separated for clarity.
Figure 4:
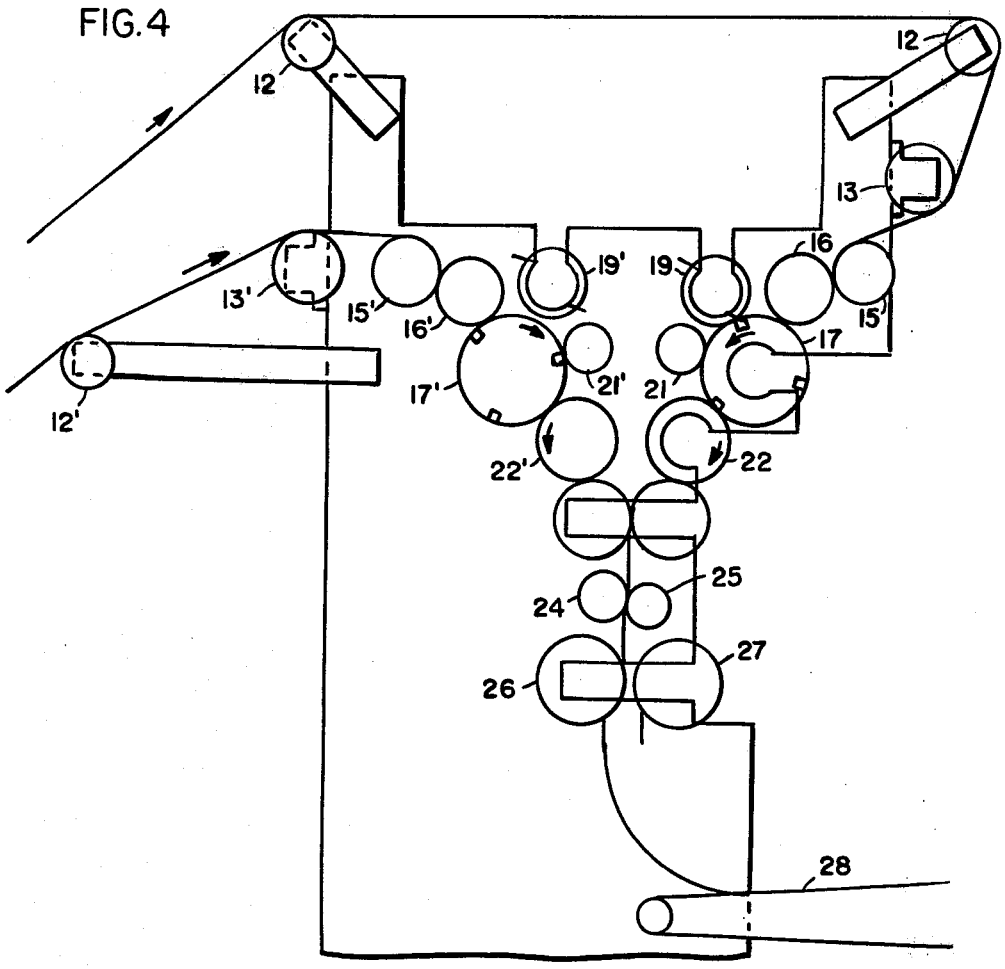
FIG. 4 is a schematic elevational view of an apparatus producing a product where all exposed edges are trailing (as contrasted to the preceding views which relate to the production of a product where all exposed edges are leading.
Figure 5:
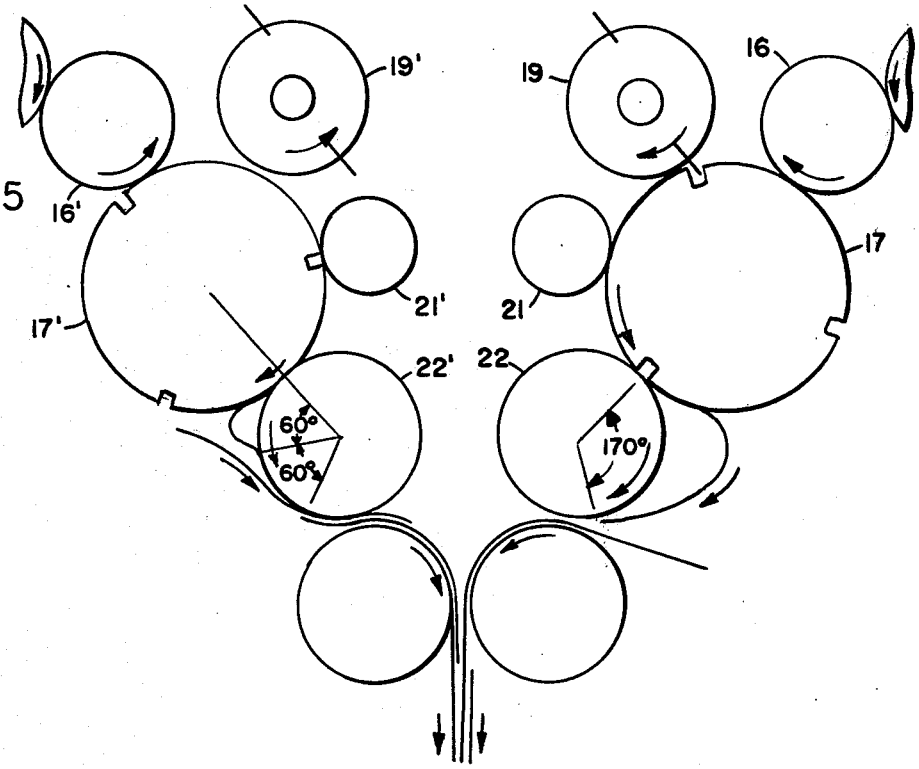
FIG. 5 is an enlarged fragmentary elevational view of FIG. 4 showing the lapping process where all exposed edges are trailing.

Referring now to FIG. 3, a schematic representation is seen of the two sets of lapped sheets after the same have been interfolded—but with the sets being separated somewhat for clarity of illustration and understanding. The web segments or sheets are numbered as in FIG. 2 but with the addition of 100 to indicate that they are in a different form. When the sheet 134' is pulled from a dispenser, it pulls with it one panel of sheet 133' as well as 2 panels of the sheet 134. Thus, there is presented to the prospective user a pair of new sheets for subsequent removal. The prospective user can pull either the sheet that projects further (the sheets 134 as illustrated in FIG. 3) or both sheets if it is desired to use two sheets of towelling, for example. Restriction of the withdrawal to one sheet can be made by installing a skirt on the front of the dispenser so that only the greater projecting sheet is seen by the prospective user. For bottom dispensing towel cabinets the stack is turned upside down for proper dispensing.

A number of advantages accrue through the practice of the invention. Notably, there is a substantial increase in production available utilizing virtually the same machinery. Now, by simply adding another lapping unit, the productive capacity of a machine currently making multi-folded towelling or tissues may be substantially increased. Further, the sheets are more easily folded inasmuch as there are 6 web portions at each fold to be handled by the grippers. Experience in this art has shown that up to a point the greater the number of plies to be folded, the easier the folding is. Another advantage resides in the fact that the stack of interfolded sheets has the same number of plies between adjacent folds which result in greater effectiveness in both manufacture and usage. This was not the case with the conventional three-leaf multi-fold. The conventional three-leaf multi-fold can be envisioned from a consideration of the left hand set of the folded sheets in FIG. 3. There, for example, it is seen that the middle panel of each fold is not associated with another panel.

Both the conventional single fold and the 3-leaf multifold have to have rather exact ratio of length of cut sheet to the width of the fold. The single fold has leading and trailing edges together while the multifold has alternately trailing and leading edges. As the producing machines get older it becomes increasingly difficult to trap both leading and/or trailing edges. When one or both edges are lost in the gripping action, it will result in the very least an unsaleable product.

In contrast, the double three-leaf multifold (as disclosed herein) has exposed edges in one direction only. The opposite edge is inside where it cannot get away. This edge could be $\frac{1}{4}''$ short without causing any harm. This makes simpler the task of millwrights charged with keeping the machines producing at full speed.

It is customary to consider surface speed of the folding rolls as the governing factor in production. In the single fold 2 sheets go through the folding rolls for each sheet length. The three leaf multifold has $1\text{-}\frac{2}{3}$sheets go through for each sheet length. The double three-leaf multifold has the $1\text{-}\frac{2}{3}$plus $2\times\frac{2}{3}$, equaling three sheets for each sheet length. Thus the productive capacity of a double three leaf multifold machine is 50% higher then and equivalent singlefold machine, and 80% higher than an equivalent conventional three leaf multifold machine without increasing the speed of the machine.

I claim:

1. A method of lapping sheets comprising:

advancing a web from each of a pair of parent rolls, transversely severing each web into discrete identical sheets having leading and trailing edges and to form a series of moving sheets from each web wherein each sheet of a series is adjacent a preceding sheet and a following sheet, retarding each sheet in each series to lap the same relative to its preceding and following sheets, retarding one series relative to the other so that upon combining the two series the leading and trailing edges of one series will be offset relative to the leading and trailing edges of the other series, orienting the lapped sheets in one series reversely to the orientation of the sheets in the other series so that upon combining the two series only one of the leading and trailing edges is exposed and facing in the same direction, and combining the two series of sheets.

2. The method of claim 1 in which the lapping of said sheets is no more than one-third the length of each of said preceding and following sheets.

3. The method of claim 1 in which the combined sheets are subsequently zig-zag folded.

* * * * *